United States Patent [19]

Hawkins

[11] Patent Number: 4,721,265

[45] Date of Patent: Jan. 26, 1988

[54] ELECTRONIC TOILET TISSUE DISPENSER

[76] Inventor: Junior F. Hawkins, 3120 W. 16th, Wichita, Kans. 67203

[21] Appl. No.: 872,041

[22] Filed: Jun. 9, 1986

[51] Int. Cl.[4] ..... B65H 16/00; G01V 9/04

[52] U.S. Cl. ..... 242/55.53; 242/55.2; 250/221

[58] Field of Search ..... 242/55.53, 55.2; 250/221; 200/DIG. 36; 307/117; 361/177, 176

[56] References Cited

U.S. PATENT DOCUMENTS

| | | | |
|---|---|---|---|
| 3,167,367 | 1/1965 | Rozlog et al. | 242/55.53 |
| 3,167,368 | 1/1965 | Rozlog et al. | 242/55.53 |
| 3,297,269 | 1/1967 | McGrew | 242/55.53 |
| 3,301,617 | 1/1967 | Goodwin et al. | 242/55.53 X |
| 3,450,363 | 6/1969 | Williams | 242/55.53 |
| 3,951,485 | 4/1976 | Schnyder et al. | 242/55.53 X |
| 3,963,190 | 6/1976 | Wilson | 242/55.53 |
| 3,986,677 | 10/1976 | Ootaki et al. | 242/55.53 |
| 4,329,581 | 5/1982 | Helfrich, Jr. et al. | 250/221 |

FOREIGN PATENT DOCUMENTS

| | | | |
|---|---|---|---|
| 2058717 | 4/1981 | United Kingdom | 242/55.2 |

*Primary Examiner*—Stuart S. Levy
*Assistant Examiner*—Thomas R. Hannon
*Attorney, Agent, or Firm*—John Wade Carpenter

[57] ABSTRACT

The Electronic Toilet Tissue Dispenser permits toilet tissue to be dispensed from a supply roll by placing your hand in front of a sensor and advancement is stopped when your hand is removed from in front of the sensor, thereby, permitting those with Arthritis and those who might have difficulty reaching; seeing or finding the end of the tissue, to easily dispense said toilet tissue.

18 Claims, 3 Drawing Figures

ELECTRONIC TOILET TISSUE DISPENSER

BACKGROUND OF THE INVENTION

1. Field of the Invention

This invention relates to an electronic means of dispensing toilet tissue paper.

2. Description of the Prior Art

Prior to my invention, there was no electronic means of dispensing toilet tissue paper. Tissue could only be dispensed by manually searching for the end of the tissue and then unwinding the amount needed by hand.

SUMMARY OF THE INVENTION

The Electronic Toilet Tissue Dispenser dispenses toilet tissue from a supply roll when your hand or other object is placed in front of a sensor located on or near the front of the device and the dispensing of toilet tissue is stopped when your hand or other object is removed from in front of said sensor. Dispensing of tissue is also stopped when normal room lighting is not present. Therefore, this device permits toilet tissue to be easily dispensed by those who might otherwise consider this to be a difficult to impossible task such as those individuals with Arthritis and those who might have difficulty reaching, seeing or finding the end of the tissue.

Further objects of my invention will become apparent from consideration of the drawings and the ensuing description thereof.

DESCRIPTION OF THE PREFERRED EMBODIMENT

Figure 1:
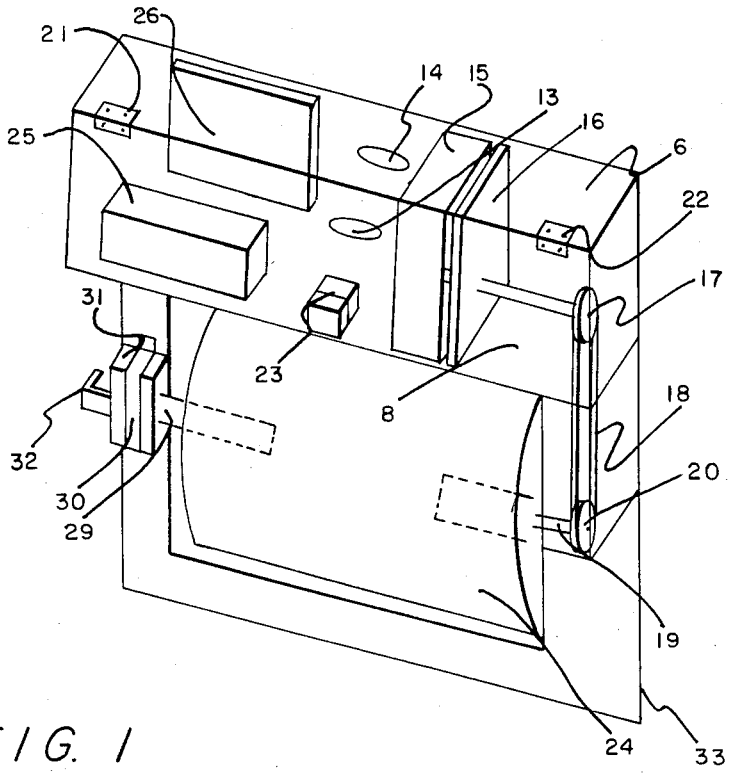
FIG. 1 is a perspective view of the Electronic Toilet Tissue Dispenser.
Figure 2:
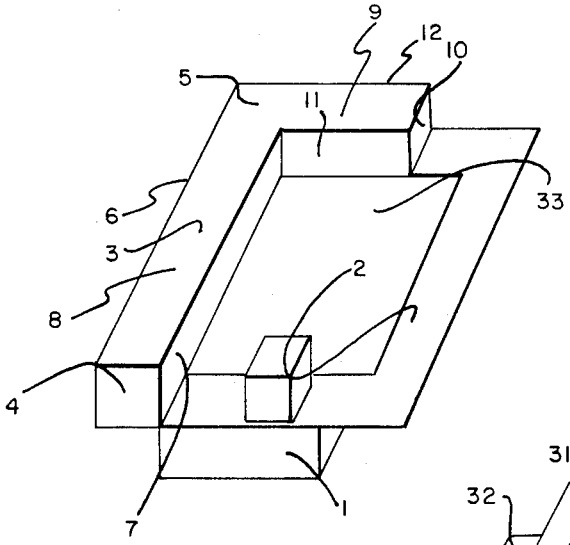
FIG. 2 is a side view of the device.

Referring to FIG. 1 and FIG. 2 the Cabinet 33 comprises a Box 1; a Control Compartment 3 and a Guard Compartment 9. Said Box 1 consists of a box shape with sides, ends and a back in which said Box 1 will accomodate a roll of Tissue Paper 24 and said Box 1 may be inserted into a wall opening much the same as current commercially available tissue holders. Screws through the bottom of said Box 1 and on into a wall stud or other wall member will secure the entire unit in its proper location.

To said Box 1 is added Horizontal Panel 2 covering all four sides of said Box 1 which stops said Box 1 at a predetermined depth when said Box 1 is inserted into a wall opening since said Horizontal Panel 2 is wider than said wall opening. Using the top of said Horizontal Panel 2 as a Back, a Control Compartment 3 is formed by adding a Left End Panel 4; a Top Panel 6; and a Bottom Panel 7 and a Front Panel 8. An opening is made in said Bottom Panel 7 to accomodate the Drive Belt 18 and related components.

A Guard Compartment 9 is also formed which serves as a guard for said Drive Belt 18 and related components. This said Guard Compartment 9 is formed by using said Horizontal Panel 2 nearest the drive assembly side as the Back and adding an End Panel 10 and a Right Side Panel 12 and a Left Side Panel 11. The said Left Side Panel 11 next to said Tissue Roll 24 contains an opening for the Drive Bearing 19. Said Left Side Panel 11 and said Right Side Panel 12 are attached to said Bottom Panel 7 of said Control Compartment 3 or otherwise made an integral part of said Control Compartment 3. The top of said Guard Compartment 9 is part of said Front Panel 8 which covers both said Control Compartment 3 and said Guard Compartment 9. The said Front Panel 8 attaches to said Top Panel 6 by Hinges 21 and Hinges 22 and is secured in place during normal operation by the Friction, magnetic or other suitable catch 23.

Said Cabinet 33 may be constructed from glass, plastic, metal, paper or other material and still perform its intended purpose.

Referring to FIG. 1 the Motor 15 is attached to the Motor Mounting Bracket 16 by screws or other suitable means which will insure that said Motor 15 is firmly secure in its proper location. Said Motor Mounting Bracket 16 is attached to panels forming said Control Compartment 3 or is otherwise made an integral part of said Control Compartment 3. An opening is made in said Motor Mounting Bracket 16 to accomodate the motor drive shaft which permits the Motor Pulley 17 to be installed on said motor drive shaft by conventional means.

A Drive Pulley 20 is bolted, glued or otherwise attached or made an integral part of said Drive Bearing 19. Said Drive Belt 18 is used to turn said Motor Pulley 17 and said Drive Pulley 20 when said Motor 15 is energized. Said Drive Bearing 20 is a cone shaped device which is slightly smaller in diameter than the inside diameter of the core holding said Toilet Tissue 24. Said Drive Bearing 19 is covered with a sandpaper type of material; constructed from perforated plastic; perforated steel or similar type of material which when inserted into the core of said Toilet Tissue Roll 24, sufficient pressure and friction will be created that the friction surface of said Drive Bearing 19 will cause said Toilet Tissue Roll 24 to turn and the tissue wound thereon to be dispensed whenever said Motor 15 is energized.

Figure 3:
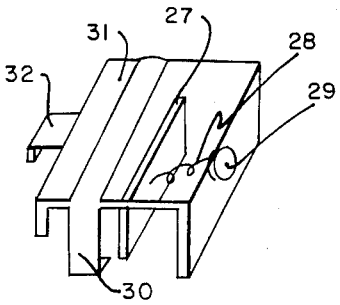
FIG. 3 is a perspective view of the assembly securing the supply tissue roll in place.

Referring to FIG. 3, the Bearing 29 holds one end of said Toilet Tissue Roll 24 in its proper place during normal operation of said device. Said Bearing 29 which is inserted into the core of said Toilet Tissue Roll 24 is slightly smaller in diameter than the core diameter of the tube holding said Toilet Tissue which permits said Toilet Tissue Supply Roll 24 to spin freely on said Bearing 29 when said Motor 15 is energized. Bracket 30 holds the Frame Assembly 31 in its proper location. A Spring 28 is attached to the Stop Member 27 and to said Bearing 29 with said Bearing 29 also attached to said Frame Assembly 31. The Handle 32 is attached to or or otherwise made an integral part of said Frame Assembly 31. When said Handle 32 is pulled, said Frame Assembly 31 will remove said Bearing 29 from said Toilet Tissue Roll 24 and the distance said Frame Assembly 31 may be pulled is determined by the location of said Stop Member 27. While said Frame Assembly 31 is in its maximum pulled position, a new said Toilet Tissue Roll 24 may be installed by first placing one end of said Toilet Tissue Roll 24 on said Drive Bearing 19 and then releasing said Handle 32 which permits said Spring 28 to force said Bearing 29 forward to a point where it may be inserted into the core of the tube holding said Toilet Tissue Roll 24. Once inserted, said Spring 28 will continue to hold said Toilet Tissue Roll 24 in its proper location. Said Stop Member 27 and Bracket 30 are attached to or otherwise made an integral part of said Horizontal Panel 2.

The Electronic Toilet Tissue Dispenser is designed to operate only when normal room lighting is present. When normal room lighting is not striking the Night Sensor 14, the said Control Circuit 26 cannot energize said Motor 15 and tissue cannot be dispensed. If normal room lighting is striking said Night Sensor 14, then by placing your hand or other object in front of the Day Sensor 13, which is a light sensitive device similar to said Night Sensor 14, then said action will cause said Control Circuit 26 to energize said Motor 15 using the Battery Power Supply 25 or other suitable power means such as A.C. or power provided by a commercially available A.C. to D.C. converter or if desired, said Control Circuit could be wired to convert standard 110 Volt household current to the required direct current from a number of well known circuits.

Once said Motor 15 is energized, it will cause said Drive Belt 18 and said Motor Pulley 17 and said Drive Pulley 20 to turn and subsequently the Toilet Tissue paper is advanced from its roll. Said Tissue Paper will continue to advance until your hand or other object is removed from in front of said Day Sensor 13 or else normal room lighting is removed from said Night Sensor 14. Without the action of said Night Sensor 14, the Toilet Tissue would advance each time normal room lighting was removed.

While the above description contains many specifities, these should not be construed as limitations on the scope of the invention, but rather as an exemplification of one preferred embodiment thereof. Many other variations are possible. For example, different sensing devices such as proximity detectors could be used and different sizes, shapes and means may be used to advance the Toilet Tissue and still remain within the spirit of this invention. Accordingly, the scope of this invention should be determined not by the embodiment illustrated but by the appended claims and their legal equivalents.

What I claim is:

1. A toilet tissue dispenser comprising a box having a back and four upstanding walls connected to the back such that the tops of the four upstanding walls form an opening; a panel means having four panel sides integrally bound to each other and secured to the tops of the four upstanding walls and flanging outwardly therefrom; a generally L-shaped compartment means mounted on two panel sides, said compartment means comprising a control compartment means secured to one panel side and a guard compartment means mounted to a panel side contiguous to the panel side that supports the control compartment; a drive motor means mounted in said control compartment means; a control circuit means mounted in said control compartment means for controlling the operation of said drive motor means; a night sensor means mounted in said control compartment means and communicating with ambient light such that when ambient light does not strike the night sensor means said control circuit means can not energize the drive motor means; a day sensor means mounted in said control compartment means and communicating with said ambient lighting such that if ambient lighting is striking the night sensor means, then interrupting the ambient lighting to the day sensor means causes the control circuit means to energize the drive motor means; a stop member mounted to the panel side that is opposed to the panel side that supports the guard compartment; a bracket assembly superimposed over the stop member and slidably mounted transverse to the panel side that is opposed to the panel side that supports the guard compartment; and a means secured to said stop member and to bracket assembly for biasing said bracket assembly away from said stop member.

2. The toilet tissue dispenser of claim 1 wherein said panel means has an internal perimeter where the tops of the four upstanding walls connect thereto.

3. The toilet tissue dispenser of claim 2 wherein said four panel sides flange outwardly from the four upstanding walls generally normal thereto.

4. The toilet tissue dispenser of claim 3 wherein said control compartment means and said guard compartment means comprise a common L-shaped compartment top.

5. The toilet tissue dispenser of claim 4 additionally comprising a handle secured to said bracket assembly.

6. The toilet tissue dispenser of claim 5 additionally comprising a bearing bound to said bracket assembly.

7. The toilet tissue dispenser of claim 6 additionally comprising a motor pulley coupled to said drive motor means, said motor pulley disposed in said control compartment.

8. The toilet tissue dispenser of claim 7 additionally comprising a drive pulley rotatably disposed in said guard compartment means, and an endless belt trained over said motor pulley and said drive pulley.

9. The toilet tissue dispenser of claim 8 additionally comprising a drive bearing means bound to said drive pulley to receive rotational power therefrom.

10. The toilet tissue dispenser of claim 9 additionally comprising a power source means mounted in said control compartment.

11. The toilet tissue dispenser of claim 10 wherein said L-shaped compartment top is pivotally mounted to said control compartment.

12. A method for dispensing toilet tissue comprising the steps of:

(a) providing a panel means circumscribing a box;

(b) mounting rotatably a roll of toilet tissue to the panel means such that said roll of toilet tissue rotates in said box spacedly;

(c) providing a night sensor means in a control compartment means supported by said panel means wherein said night sensor means communicates with ambient light such that when ambient light does not strike the night sensor means a control circuit means mounted in said control compartment means can not energize a drive motor means to rotate the roll of toilet tissue in order to dispense toilet tissue therefrom;

(d) providing a day sensor means in said control compartment wherein said day sensor means communicates with ambient lighting such that if ambient lighting is striking the night sensor means, then interrupting the ambient lighting to the day sensor means causes the control circuit means to energize the drive motor means to rotate the roll of toilet tissue in order to dispense toilet tissue therefrom;

(e) striking the night sensor means with ambient lighting;

(f) covering contactless the day sensor means to interrupt ambient lighting to the day sensor means causing the control circuit means to energize the drive motor means and commence the rotating of the roll of toilet tissue;

(g) maintaining said covering step (f) until the desired amount of toilet tissue has rotated off of the roll of toilet tissue; and (h) removing said covering step (f) such that the day sensor again communicates with the ambient lighting to cause the control circuit means to deengage the drive motor means and stop the rotating of the roll of toilet tissue.

13. The method of claim 12 additionally comprising removing said desired amount of toilet tissue from the roll of toilet tissue.

14. The method of claim 13 additionally comprising providing a stop member bound to the panel means.

15. The method of claim 14 additionally comprising superimposing a bracket assembly over the stop member, and mounting slidably the bracket assembly to the panel means such that the bracket assembly slides transversely with respect to a portion of the panel means.

16. The method of claim 15 additionally comprising providing a spring means between said stop member and said bracket assembly.

17. The method of claim 16 additionally comprising sliding the bracket assembly transversely with respect to the portion of the panel means to bias the bracket assembly against the stop member.

18. The method of claim 17 additionally comprising removing the roll of toilet tissue after said sliding step and replacing the roll of toilet tissue with another roll of toilet tissue.

* * * * *